US010113356B2

(12) United States Patent
Lenox et al.

(10) Patent No.: US 10,113,356 B2
(45) Date of Patent: Oct. 30, 2018

(54) INSERTS FOR HOLLOW STRUCTURAL MEMBERS

(71) Applicant: Alcoa Inc., Pittsburgh, PA (US)

(72) Inventors: Ronald M. Lenox, Cranberry Township, PA (US); Sneh Kumar, Pittsburgh, PA (US)

(73) Assignee: Arconic Inc., Pittsburgh, PA (US)

( * ) Notice: Subject to any disclaimer, the term of this patent is extended or adjusted under 35 U.S.C. 154(b) by 72 days.

(21) Appl. No.: 15/061,050

(22) Filed: Mar. 4, 2016

(65) Prior Publication Data

US 2016/0201383 A1 Jul. 14, 2016

Related U.S. Application Data

(63) Continuation of application No. 14/556,909, filed on Dec. 1, 2014, now abandoned, which is a continuation (Continued)

(51) Int. Cl.

*E06B 7/16* (2006.01)
*E04B 1/68* (2006.01)

(Continued)

(52) U.S. Cl.

CPC ..... *E06B 7/16* (2013.01); *E04B 1/6801* (2013.01); *E05D 15/0621* (2013.01);

(Continued)

(58) Field of Classification Search

CPC ..... E05D 15/165; E05D 15/18; E05D 15/244; E05D 15/0621; E05D 15/0052; E05D 15/1691; E06B 7/16; E06B 7/205; E06B 7/22; E06B 7/23; E06B 7/2303; E06B 3/263; E06B 3/26301; E06B 3/26303; E06B 3/26305; E06B 3/26307; E06B 3/26343; E06B 3/26347; E06B 2003/26321; E06B 2003/26329; E06B 2003/26327;

(Continued)

(56) References Cited

U.S. PATENT DOCUMENTS 2,660,275 A 11/1953 Beck
3,114,179 A * 12/1963 Briggs ..... E06B 3/26301 49/DIG. 1

(Continued)

FOREIGN PATENT DOCUMENTS

EP 2136024 A1 * 12/2009 ..... E06B 3/26303
EP 2136024 11/2011

*Primary Examiner* — Jessica L Laux
(74) *Attorney, Agent, or Firm* — Greenberg Traurig, LLP

(57) ABSTRACT

A pre-formed insert with stable dimensions for mechanical insertion into a hollow member and that reduces the Nusselt number and convection across the hollow member. The insert may be formed of a low heat conducting material like PVC and have extensions and internal voids that impede convection in the hollow and conduction through the insert. The inserts may be used in heads and sills of aluminum windows, doors and frames. In one embodiment, an insert is received in an open hollow and may cooperate with an insert in a frame hollow to decrease convection at the head end of a sliding window or door. An insert may be placed within the hollow of a window or door beside a roller assembly.

17 Claims, 7 Drawing Sheets

Exhibit A

Related U.S. Application Data of application No. 13/591,649, filed on Aug. 22, 2012, now abandoned.

(51) Int. Cl.

| | |
|---|---|
| ***E05D 15/06*** | (2006.01) |
| ***E05D 15/16*** | (2006.01) |
| ***E06B 1/16*** | (2006.01) |
| ***E06B 1/36*** | (2006.01) |
| ***E06B 1/52*** | (2006.01) |
| ***E06B 1/70*** | (2006.01) |
| ***E06B 3/34*** | (2006.01) |
| ***E06B 3/263*** | (2006.01) |

(52) U.S. Cl.

CPC ..... *E05D 15/165* (2013.01); *E06B 1/16* (2013.01); *E06B 1/36* (2013.01); *E06B 1/52* (2013.01); *E06B 1/70* (2013.01); *E06B 3/26303* (2013.01); *E06B 3/34* (2013.01); *E06B 3/26347* (2013.01); *E06B 2001/707* (2013.01); *E06B 2003/26321* (2013.01); *E06B 2003/26327* (2013.01); *E06B 2003/26389* (2013.01)

(58) Field of Classification Search

CPC ... E06B 2003/2633; E06B 2003/26332; E06B 2003/26349; E06B 2003/2635; E06B 2003/26352; E06B 2003/26369; E06B 2003/26389; E06B 2003/26347; E06B 1/52; E06B 1/12; E06B 1/16; E06B 1/18; E06B 2001/707

See application file for complete search history.

(56) References Cited

U.S. PATENT DOCUMENTS

| | | | | |
|---|---|---|---|---|
| 3,203,053 | A | 8/1965 | Lane et al. | |
| 3,336,713 | A | 8/1967 | Yves | |
| 3,517,472 | A | 6/1970 | Toth | |
| 3,527,011 | A | 9/1970 | Bloom et al. | |
| 3,579,724 | A | 5/1971 | Toth | |
| 4,117,640 | A | 10/1978 | Vanderstar | |
| 4,272,941 | A | 6/1981 | Hasselbacher et al. | |
| 4,330,919 | A | 5/1982 | Bischlipp et al. | |
| 4,461,133 | A | 7/1984 | Laroche | |
| 4,569,170 | A | 2/1986 | Gertner | |
| 4,640,078 | A | 2/1987 | Haffer | |
| 8,001,743 | B2 * | 8/2011 | Lambertini | E06B 3/26347 403/37 |
| 8,112,941 | B2 | 2/2012 | Lenox | |
| 8,578,668 | B2 * | 11/2013 | Joray | E05D 15/0665 52/207 |
| 9,127,498 | B1 * | 9/2015 | Ye | E06B 3/24 |
| 2002/0046539 | A1 | 4/2002 | Schulz | |
| 2003/0201071 | A1 * | 10/2003 | Kobayashi | E06B 3/26301 160/10 |
| 2005/0115193 | A1 | 6/2005 | Brunnhofer | |
| 2007/0234657 | A1 * | 10/2007 | Speyer | E06B 7/23 52/207 |
| 2012/0214397 | A1 * | 8/2012 | Strycharske | E06B 3/26347 454/195 |
| 2013/0118106 | A1 * | 5/2013 | Clark | E04B 1/78 52/404.4 |
| 2014/0053488 | A1 | 2/2014 | Lenox et al. | |
| 2017/0089121 | A1 * | 3/2017 | Clark | E06B 3/26305 |

* cited by examiner

Exhibit A

INSERTS FOR HOLLOW STRUCTURAL MEMBERS

CROSS REFERENCE TO RELATED APPLICATION

This application is a continuation application of U.S. application Ser. No. 14/556,909, filed Dec. 1, 2014, entitled, "Inserts for Hollow Structural Members" which is a continuation of Ser. No. 13/591,649 filed Aug. 22, 2012, entitled, "Inserts for Hollow Structural Members", both of which applications are incorporated by reference herein in their entirety.

STATEMENT REGARDING FEDERALLY SPONSORED RESEARCH

The development of the disclosed subject matter was supported by funds from the U.S. Department of Energy Award No. DE-EE0004012. The U.S. government has rights in the invention.

FIELD

The present invention relates to windows and doors, and more particularly, to apparatus and methods for changing the rate of energy transfer through doors, windows and assemblies having internal hollows.

BACKGROUND

Windows, doors, skylights and structural components made from materials such as aluminum, alloys thereof, steel and plastics having internal hollows are known. For example, window and door assemblies may be made from metal extrusions. Devices and methods have been proposed for altering the transfer of energy through such structural components, such as thermal breaks and various types of weather stripping. Notwithstanding, alternative methods, apparatus and manufactures for modifying energy transfer through windows, doors and other structural components having internal hollows remains desirable.

SUMMARY

The disclosed subject matter relates to a structure for a building envelope dividing an exterior environment from an interior environment having a composite member with a pair of metal extrusions having a first thermal conductivity, the pair of extrusions connected by a thermal break formed from a material having a lower thermal conductivity than the metal extrusions, a first of the pair of extrusions being an exterior extrusion and a second of the pair being an interior extrusion. The composite member has a portion with an open, C-shaped cross-sectional shape, the hollow of the C-shaped cross-sectional shape communicating with a space exterior to the composite member, the hollow supporting heat transfer by convection between the pair of metal extrusions. The structure has an insert formed independently of the composite member having stable free-standing dimensions, the insert capable of insertion into the hollow and extending at least partially across the hollow when inserted therein, the insert being made from a material with a thermal conductivity less than the thermal conductivity of the metal extrusions and having a cross-sectional shape which at least partially subdivides the hollow into a plurality of sub-areas, the insert having a cross-sectional shape with a first wall having a first orientation extending at least partially across the open C-shape, the first wall having a first end and a second end, the insert having a second wall projecting from the first wall at an angle relative to the first wall intermediate the first end and the second end, the second wall projecting into the hollow, the second wall having a free end distal to the first wall, the insert capable of reducing the Nusselt number of the member when inserted into the hollow relative to the Nusselt number of the member without the insert present in the hollow.

In another aspect, the second wall includes a plurality of second walls spaced apart from one another and extending from the first wall.

In another aspect, the second wall extends from the first wall and has a component of extension in a direction toward the thermal break.

In another aspect, a third wall extends from the first wall and has a component of extension opposite to the direction of extension of the second wall.

In another aspect, the second wall extends from the first wall and has a component of extension in a direction away from the thermal break.

In another aspect, a third wall extends from the first wall and has a component of extension opposite to the direction of extension of the second wall.

In another aspect, the second wall includes a plurality of spaced second walls and the third wall includes a plurality of spaced third walls.

In another aspect, an end wall extends from the first wall at either the first end or the second end thereof, at least one of the pair of extrusions having an upstanding bead on the portion having a C-shape, the bead extending into the hollow and wherein the end wall has a recess therein capable of receiving the upstanding bead, the end wall being resilient and capable of assuming a first bent shape permitting the end wall to be pushed over the bead when the insert is pushed into the hollow and receiving the bead in the recess and having a second, relaxed shape wherein the end wall is generally parallel to a portion of the at least one extrusion proximate the bead, locking the insert in place within the hollow.

In another aspect, the end wall has a lead-in portion at a free end thereof extending at an angle from the end wall, the lead-in slipping over the bead when the insert is pressed into the hollow.

In another aspect of the disclosure, each of the pair of extrusions have an upstanding bead extending therefrom towards the hollow, the insert being retained in the hollow by interaction with the pair of beads.

In another aspect, the first wall is disposed perpendicular to the second wall.

In another aspect, the composite member receiving the insert is at least one of a head or a sill of a door.

In another aspect, the composite member receiving the insert is at least one of a head or a sill of a window.

In another aspect, the insert is composed of at least one of PVC and polyurethane.

In another aspect, the second wall engages the composite member to support the insert in the member.

In another aspect, at least one of the second wall or the third wall is composed of a deformable, low durometer material.

In another aspect, the structure is a sliding access device having a frame with a head having the composite member with the C-shaped open hollow as a first hollow, a panel capable of sliding relative to the frame and having a head with a second composite member with a second C-shaped open hollow, the first hollow and the second hollow facing each other, the insert being received in the frame bridging the first open hollow and being a first insert; a second insert being received in the panel bridging the second open hollow.

In another aspect, the first insert has a cross-sectional shape with a U shape, and the second insert has a cross-sectional shape with a U shape, the U shape of the first insert and the U shape of the second insert interdigitating, producing a tortured constricted path for air passing through the first and second hollows, such that the panel can be lifted into the frame and the first insert and the second insert reduce the heat transfer through the conjoined first and second hollows when the panel is installed in the frame.

In another aspect, the C-shaped open hollow has a pair of retainer beads extending from the interior of the C-shape and retaining opposing edges of the first insert and the second C-shaped hollow has a pair or retainer ledges extending from the interior of the C-shape, the second insert having a pair of resilient arms with retainer tips that engage the retainer ledges when in a relaxed state.

In another aspect, the structure is a sliding access device with a frame having a sill, the sill having the composite member with the C-shaped open hollow and further including a track disposed within the hollow of the composite member of the sill, a panel capable of sliding relative to the frame and having a second C-shaped open hollow along a bottom portion of the panel, the first hollow and the second hollow facing each other, a roller assembly disposed in the second hollow for supporting the panel slidably within the frame, the roller assembly engaging and rolling on the track, the insert received within the hollow of the sill, the insert having a support member for the track extending from the first wall in a direction away from the thermal break of the composite member of the sill intermediate the first end and the second end of the first wall, a second insert inserted into the second hollow positioned proximate to and supporting the roller assembly the first insert and the second insert decreasing the Nusselt number of the sliding access device relative to the Nusselt number of the sliding access device without the first and second inserts.

In another aspect, the second insert has a hollow T-shaped cross-sectional shape.

In another aspect, a method for making the structure includes forming the pair of metal extrusions; forming the thermal break; joining each of the extrusions to opposing sides of the thermal break to form the composite member; independently forming the insert from a polymer material, the dimensions of the insert permitting insertion of the insert into the hollow after independent formation of the member, the member being assembled without intermediation of the insert; inserting the insert into the hollow of the rigid member such that the insert extends at least partially across the hollow when inserted therein, the insert reducing the Nusselt number of the member when inserted into the hollow relative to the Nusselt number of the member without the insert present in the hollow by reducing heat transfer by convection across the hollow between the metal extrusions.

BRIEF DESCRIPTION OF THE DRAWINGS

For a more complete understanding of the present invention, reference is made to the following detailed description of exemplary embodiments considered in conjunction with the accompanying drawings.

DETAILED DESCRIPTION OF EXEMPLARY EMBODIMENTS

Figure 1:
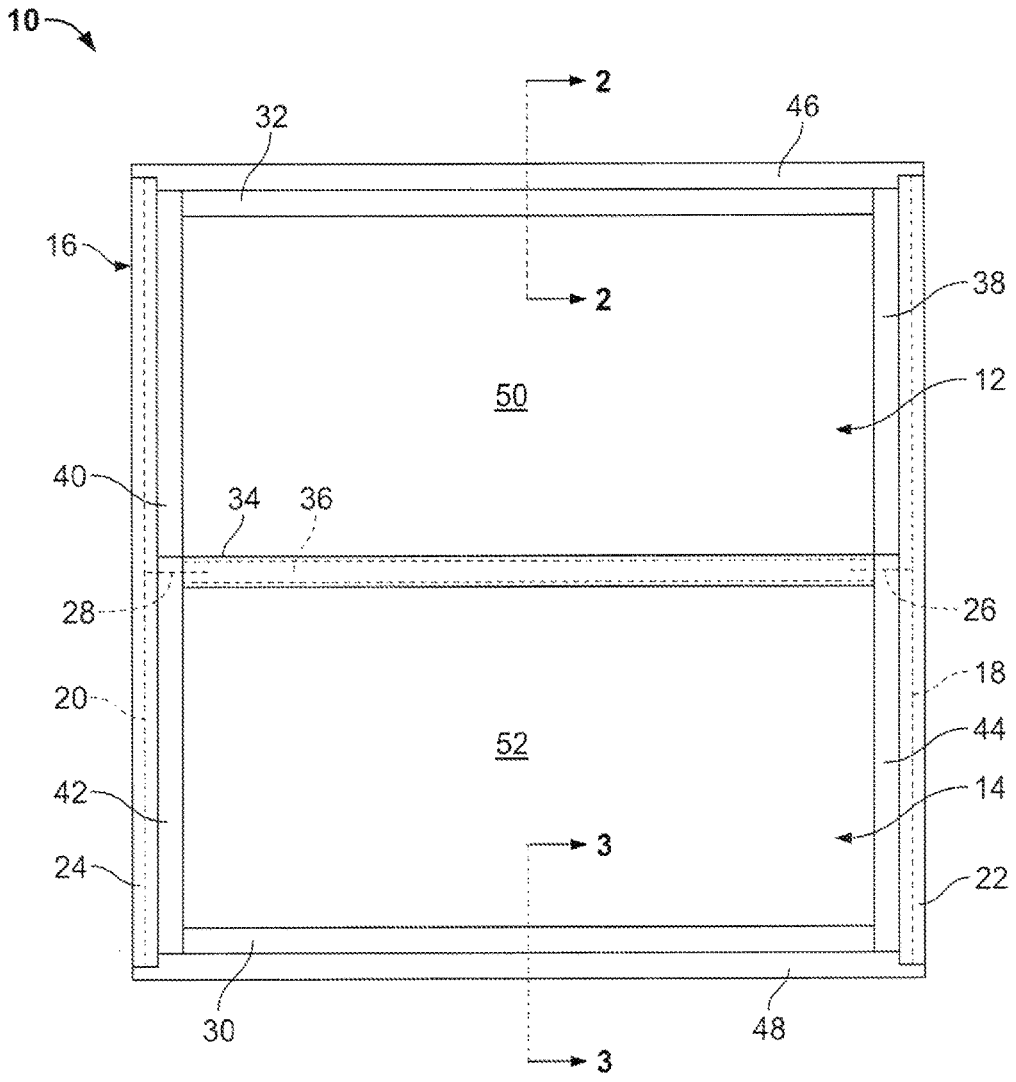
FIG. 1 is a front view of a vertically operating hung-type window assembly in accordance with an embodiment of the present disclosure.

FIG. 1 shows a window assembly 10 having upper and lower sashes 12, 14 held within frame 16. In the case of a hung window, typically at least one of the sashes 12, 14 slides within opposing tracks 18, 20 (shown diagrammatically in dotted lines) in jambs 22, 24 to allow opening/closing the window assembly 10. Alternatively, with double-hung windows, both sashes 12, 14 slide up and down. With single-hung windows, only the lower sash 14 slides up and down. With casement windows, hinges/pivots 26, 28 (diagrammatically shown in dotted lines) allow one of sashes 12, 14 to tip in or out relative to the frame 16, the other being stationary. Alternatively, both sashes 12, 14 may be hinge mounted. The sashes 12, 14 feature horizontally oriented rails 30, 32 (the upper check rail 34 of the lower sash 14 coinciding with the lower check rail 36 (dotted lines) of the upper sash 12) and vertically oriented stiles 38, 40, 42, 44. The upper part of the frame 12 is the head 46 and the lower part, the sill 48. The glazing 50, 52, e.g., glass or plastic is held within the sashes 12, 14.

Figure 2:
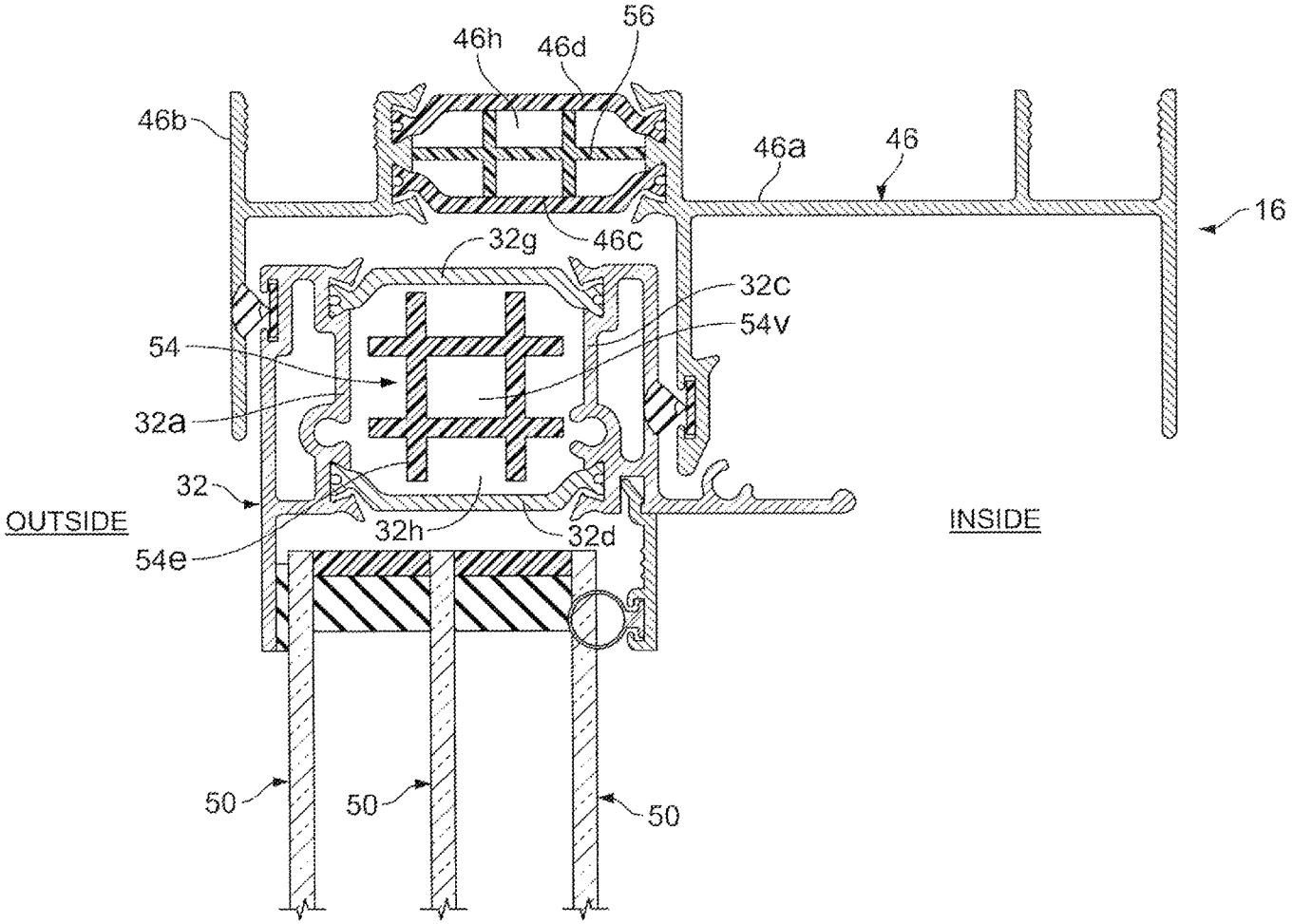
FIG. 2 is a cross-sectional view of the hung-type window of FIG. 1, taken along section line 2-2 and looking in the direction of the arrows.

FIG. 2 shows that the rail 32 may be formed from a plurality of sub-parts 32*a*-32*d*, e.g., in the form of extrusions, which are assembled together to form the rail 32, which has an internal hollow 32*h*. An insert 54 has been inserted into the hollow 32*h* for modifying the flow of heat through the rail 32 between the inside and outside. For example, on a cold day, warm inside air would heat the extrusion 32*c* which would conduct heat to extrusions 32*b* and 32*d* and then to 32*a*. In addition, heat would flow through the rail 32 via convection, the warmed extrusions 32*c*, 32*b* and 32*d* would lose heat to the air contained in the hollow 32*h*, which would then transfer this heat energy to the cold outside extrusion 32*a*, such that a continual heat transfer from inside to outside would occur. By at least partially diminishing the transfer of heat through the gas, e.g., air, within the hollow 32*h* via convection, the insert 54 may have a beneficial effect on the energy efficiency of the window, reducing the U value, the overall heat transfer coefficient and the Nusselt number, the ratio of convection heat transfer to conductive heat transfer. As is known, it is at times desirable to limit the heat transfer from outside to inside, e.g., during hot summer days, when it is preferable to maintain the inside of a structure cooler than the outside. In cold weather, the opposite objective is typically sought. The insert 54 may be formed from a material which has lower heat conducting capacity, such as a plastic like PVC or polyurethane and may have internal voids 54*v*, as well as extensions 54*e* which enlarge the geometry and gas/air movement blocking capability of the insert 54, while diminishing weight. The voids 54*v* also constitute a pocket of still gas/air captured within the insert 54 and therefore add to the insulating properties of the insert 54. The insert 54 may be proportioned relative the hollow 32*h* to allow the insert 54 to be slipped into the hollow 32*h* through an open end or to enable the insert 54 to be placed in a partially formed rail 32, e.g., after assembly of three of the subsections, e.g., 32*a-c*. The other rails 30, 34, 36 and stiles 38, 40, 42, 44 in the sashes 12, 14 may be similarly treated by the insertion of an insert like insert 54. While the foregoing description refers to structural members, such as rail 32 being formed from a plurality of sub-parts, e.g., 32*a*-32*d*, the present disclosure is applicable to structural members, such as rail 32 which is formed from fewer sub-parts or is monolithic, e.g., an extruded tube, having a square, rectangular or other cross-sectional shape, which defines a hollow, like hollow 32*h* into which an insert, like insert 54, may be placed. This observation is applicable to the other composite structural members referred to below.

FIG. 2 shows that the head 46 of the frame 16 may be formed from a plurality of subsections 46*a*, 46*b*, which are bridged by thermal breaks 46*c*, 46*d* made from a material, e.g., a polymer, that has a reduced heat conductivity relative to the subsections 46*a*, 46*b*. In this manner, the thermal breaks 46*c*, 46*d* decrease heat conduction through the frame. As shown, the thermal breaks 46*c*, 46*d* define a hollow 46*h* there between. An insert 56 may be inserted into the hollow 46*h* to subdivide the volume of the hollow 46*h* and impede air flow and associated heat transfer by convection. Insert 56 could have a grid-like cross-sectional shape like insert 54 or any other cross-sectional shape that can be accommodated within the hollow 46*h*. It should be appreciated that the inserts 54, 56 are pre-formed before insertion into the respective hollow 32*h*, 46*h*, rather than injected into a hollow and expanded via self expansion, as occurs in the case of expanding foams. While the inserts may be formed from a material that is compressible, e.g., a foam material such as polyurethane, because the inserts 54, 56 are pre-formed, they can be handled as a stable part with stable, predefined dimensions, which are inserted into the structure, e.g., 32, having the hollow 32*h* that accommodates it. In case of a compressible insert 54, 56 that is compressed prior to insertion or forced into a hollow, e.g., 32*h*, the predefined expanded dimensions of the insert 54, 56 lead to a predictable expansion force and material density within the hollow in which it is placed. In comparison, a foamable polymer that is injected into a hollow as a liquid or gel has a rate of expansion which suggests the assembly of the hollow structure within a given time before the foam expands beyond the boundary of the hollow. Alternatively, use of an expanding foam to fill a hollow may involve an entry port into a pre-formed hollow, a fill strategy/injection tool, such as an injection nozzle which inserts into the cavity fully and then is gradually withdrawn as the foam is injected, the rates of withdrawal and injection being coordinated to insure even filling of the hollow, which, in the case of a window or door, could be a long, narrow cavity and require careful metering of the foam and movement of the nozzle to prevent gaps in filling, under-filling overfilling, bulging or stresses induced in the hollow structure. Moreover, drainage and airflows are prevented in a hollow filled by a foam expanded in place, such that accumulated water may become a source of mold.

Figure 3:
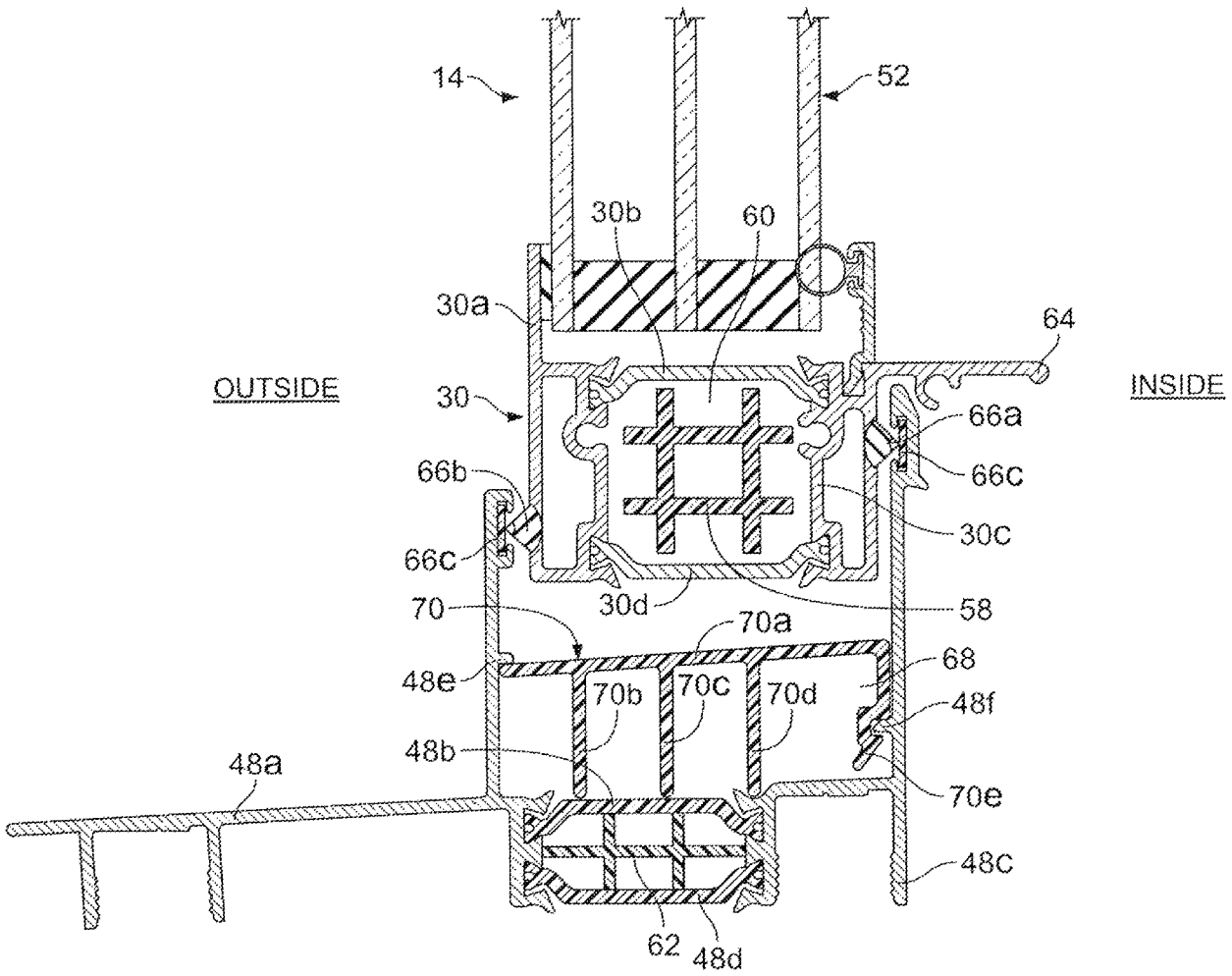
FIG. 3 is a cross-sectional view of the hung-type window of FIG. 1, taken along section line 3-3 and looking in the direction of the arrows.

FIG. 3 shows the reception of lower sash 14 within the sill 48. As with the head rail 32, the sill rail 30 may be made from sub-elements 30*a*-30*d*. Subsections 30*a* and 30*c* may be formed of metal, e.g., aluminum and subsections 30*b* and 30*d* may be formed of a polymer and function as thermal breaks. Alternatively, all subsections 30*a*-30*d* may be made from aluminum or plastic. An insert 58 may perform thermal stabilization and/or air movement disruption functions. As with insert 54, the insert 58 may have a grid-like cross-section. The sill 48 has subsections 48*a*-48*d*, with subsections 48*a* and 48*c* optionally formed of metal and 48*b* and 48*d* optionally being thermal breaks. An insert 62 may be utilized for thermal stabilization and disrupting air movement, as in the case of the inserts 54, 56 and 58 described above. The lower sash 14 has a handle 64, which may function as a finger grip by which the sash 14 is raised and lowered and which aids in aligning seals 66*a*, 66*b* on the sash 14 with their complement 66*c*, 66*d* on the sill 48, when in the closed position. When in the closed position, a hollow 68 is defined between the sash 14 and the sill 48. An insert 70 having a bridging web 70*a* and extensions 70*b*-70*e* is placed into the hollow 68 to disrupt air movement in the hollow 68 to reduce heat transfer by convection. The extensions 70*b*-70*e* optionally perform two functions, viz., to mechanically support the insert 70 relative the sill 48 and to subdivide the hollow 68 into a plurality of smaller subareas. As before, the insert 70 may be made from a material having less heat conduction than the material from which the frame 16 or sashes 12, 14 are made. For example, if the frame 16 and/or sashes 12, 14 are made from an aluminum alloy, then the insert 70 may be made from plastic/polymer, such as PVC. The subdivision of the hollow 68 by the web 70*a* and extensions 70*b*-70*e* interrupts the movement of air supporting convection and places multiple heat barriers in the direction of heat transfer (between the outside and the inside). The sill 70 may have ledges 48*e*, 48*f* that interact with the insert 70 to retain it in position in the sill 48.

Figure 4:
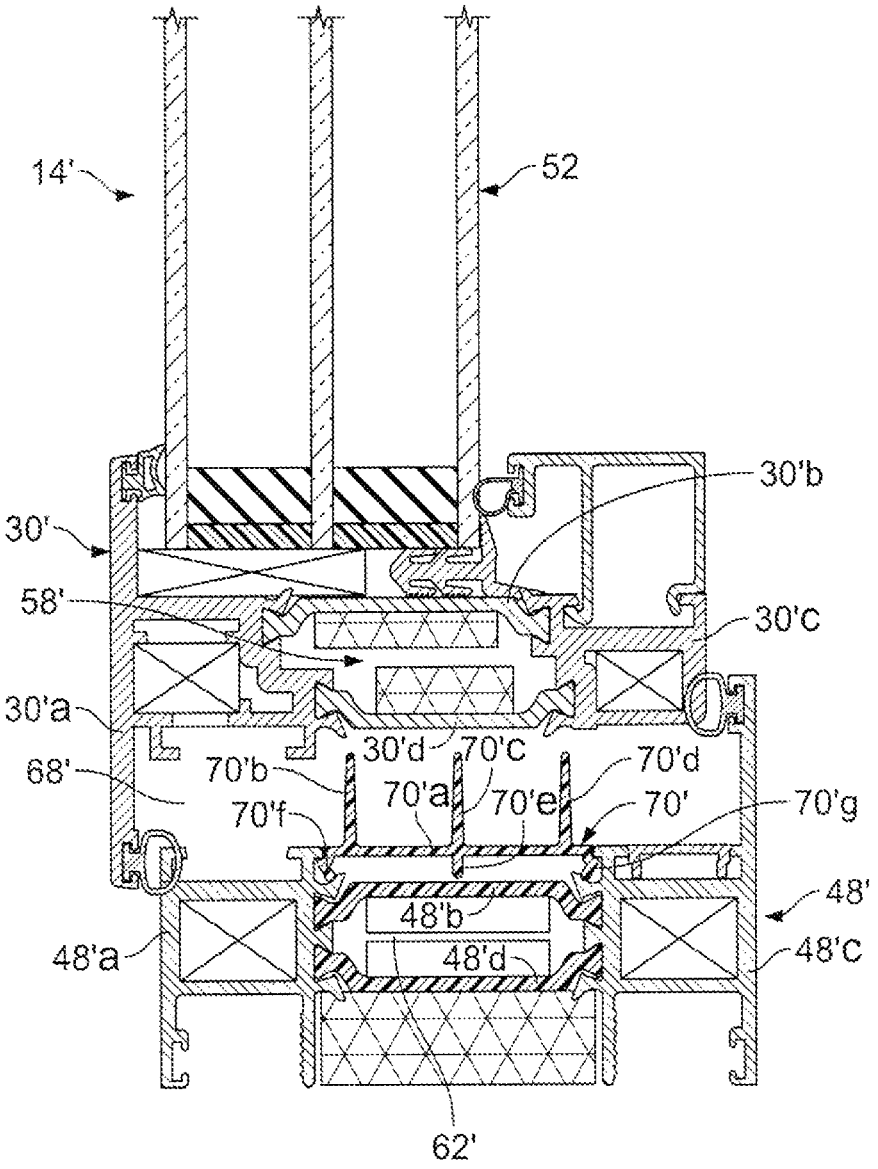
FIG. 4 is a cross-sectional view like FIG. 3, but taken of a casement type window.

FIG. 4 shows a sill 48' interacting with a sash 14' of a casement/projected window 10' (The same as window 10 of FIG. 1, but using hinge pivots 26, 28 rather than tracks 18, 20 for opening and closing.) The sill rail 30' has subsections 30'*a*-30'*d* and may utilize an insert 58' with features described above relative to insert 58 in FIG. 3. The sill 48' may also have subsections 48'*a*-48'*d* and an insert 62' like insert 62 of FIG. 3. An insert 70' is retained between subsections 48'*a* and 48'*c* and has a plurality of upstanding extensions 70'*b*-70'*d* extending from web 70'*a* that project up into the hollow 68' to divide the hollow 68' into subareas, thereby disrupting air flows that support convective heat transfer through the hollow 68'. A downward extension 70'*e* divides the hollow 68' into sub-areas and also may provide a mechanical support function. Extensions 70'*f* and 70'*g* mechanically clip the insert 70' to the sill 48'. The dimensions of the insert 70' may be modified, e.g., to extend up to the rail 30' when the sash 14' is in the closed position. The material chosen for forming the insert 70' may be a rigid plastic/polymer such as PVC. Alternatively a flexible material may be employed, such as low durometer PVC. In one embodiment the insert 70' is a composite of hard and soft materials, e.g., the web 70'*a* may be made from hard high durometer PVC and the extensions 70'*b*-70'*d* may be formed from soft, low-durometer PVC to allow deformation, e.g., to allow the rail 30' to slide over the extensions, partially deforming them until it comes to a closed position where the extensions continue to maintain contact with the rail 30'.

Figure 5:
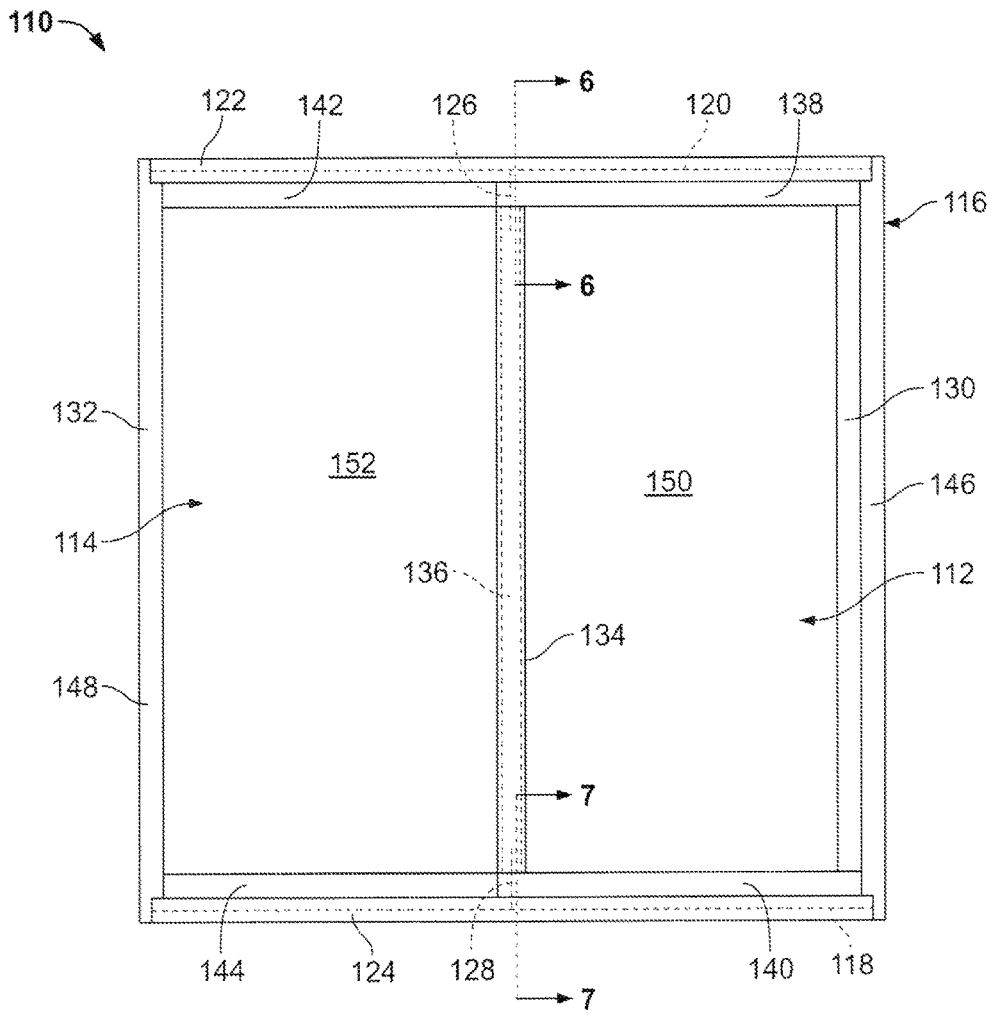
FIG. 5 is a front view of a sliding window/door assembly in accordance with an embodiment of the present disclosure.

FIG. 5 shows a sliding window/door assembly 110 having a right panel 112 and a left panel 114 captured within a frame 116. In the case of a sliding door, typically at least one of the panels 112, 114 slides within opposing tracks 118, 120 (shown diagrammatically in dotted lines) in the head 122 and the sill 124 to allow opening/closing the door assembly 110. With hinged doors, hinges/pivots 126, 128 (diagrammatically shown in dotted lines) allow one or both panels 112, 114 to open in or out relative to the frame 116, with each opening panel 112 and/or 114 having a pair of hinges/pivots like 126, 128. The panels 112, 114 feature vertically oriented stiles 130, 132 and horizontally oriented rails 138, 140, 142, 144. The center check/meeting stile 134 of the right panel 112 coincides with the check/meeting stile 136 (dotted lines) of the left panel 114. The right and left sides of the frame 116 are the jambs 146, 148. The glazing 150, 152, e.g., made from glass or plastic, is held within the panels 112, 114.

Figure 6:
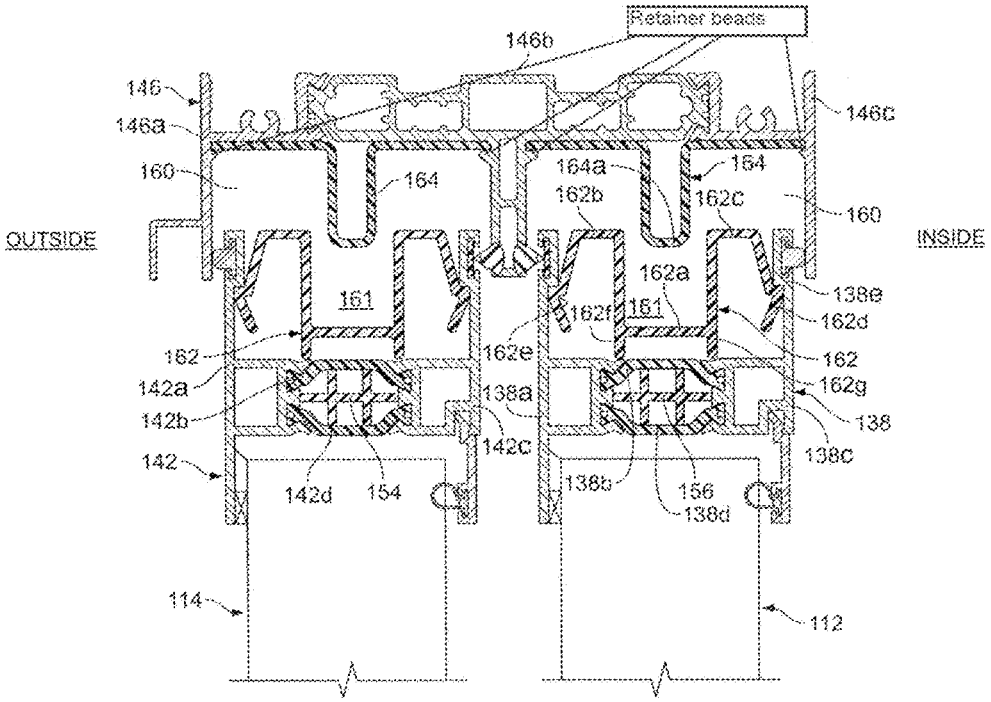
FIG. 6 is a cross-sectional view of the sliding window/door of FIG. 5, taken along section line 6-6 and looking in the direction of the arrows.

FIG. 6 shows that the rails 138, 142 may be formed from a plurality of sub-parts 138*a*-138*d*, and 142*a*-142*d*, respectively, e.g., in the form of extrusions, which are assembled together and which may include thermal breaks. For example 138*b*, 138*d* and 142*b*, 142*d*, may be made from a material, such as a polymer, with a conductivity that is less than that of the other subsections, 138*a*, 142*a*, etc., which may be made from a metal, such as, an aluminum alloy. The rails 138, 142 may be stabilized and/or have a reduced heat transfer due to inserts 154, 156, which may be made as described above in reference to the inserts 54, 56. The head 146 of the frame 116 may be a composite of a plurality of sub-sections 146*a*-146*c*, with 146*b* potentially being made of a material with lower conductivity to function as a thermal break. Hollows 160 between the rails 138, 142 and the head 146 of the frame 116, allow the panels 112, 114 to be lifted up into the head 146 for placement on the track 118 in the sill 124 and then lowered to rest on rollers (described below), while still being retained in the track 120 (See FIG. 5). Hollows 160 in the head 146 communicate with hollows 161 of the rails 138, 142. The hollows 160, 161 are subdivided into a plurality of smaller areas by inserts 162 and 164, which have complementary shapes. More specifically, inserts 162 have a U-shaped trough 162*a* disposed between two reversely bent arms 162*b*, 162*c* with ledges 162*d*, 162*e* that engage corresponding edges, e.g., 138*e*, 138*f* on the subparts 138*c* and 138*a*, respectively. Extensions 162*f*, 162*g* act as counteracting standoffs. Inserts 164 feature a U-shaped portion 164*a* depending from a web 164*b*. The U-shaped portion 164*a* extends slightly into the U-shaped trough 162*b* forcing any air traversing the hollows 160, 161 to follow a tortured, constricted path, thus reducing the movement of air and heat transfer due to convection. The complementary shapes of the U-shaped portions 164*a* and the troughs 162*b* permit the panels 112, 114 to be lifted relative to the head 146, allowing the panels 112, 114 to be installed into the frame 116. As can be appreciated from FIG. 6, panels 112 and 114 have similar features and relate to head 146 in a similar way. As an alternative embodiment, only one of the panels 112, 114 may be moveable, the other of which is stationary, such that the non-moving panel, e.g., 112 or 114, may utilize insulation and heat transfer suppression structures suitable for a stationary panel.

Figure 7:
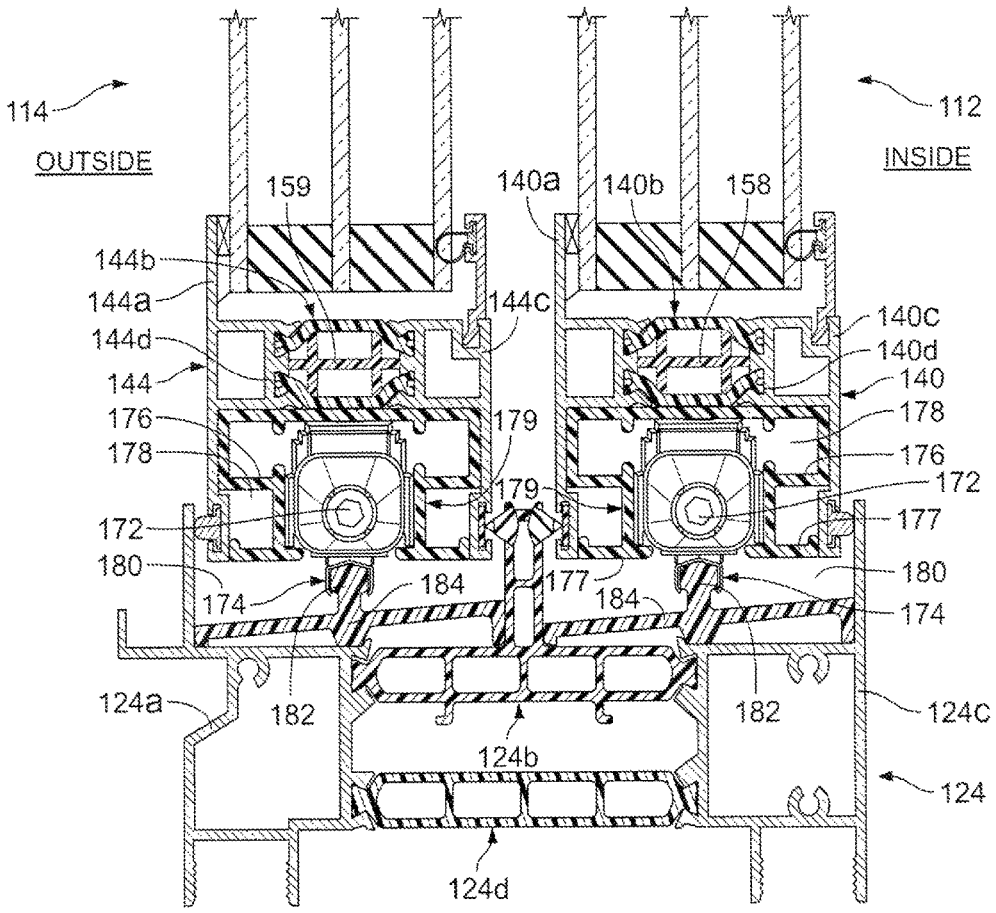
FIG. 7 is a cross-sectional view of the sliding window/door of FIG. 5, taken along section line 7-7 and looking in the direction of the arrows.

FIG. 7 shows the reception of rails 140, 144 within the sill 124. As with the head rails 138, 142, the sill rails 140, 144 may be made from sub-elements 140*a*-140*d* and 144*a*-144*d*, respectively, and may utilize inserts 158, 159 for thermal stabilization and/or to impede air movement. Subsections 140*b*, 140*d* and 144*b*, 144*d* may be formed of a polymer and function as thermal breaks. Like insert 54, the inserts 158 and 159 may have a grid-like cross-section or utilize secondary inserts like 58*a*, 58*b*, as described above. Each of the rails 140, 144 house roller assemblies 172 that permit the panels 112, 114 to be moveably supported on tracks 174 that are disposed in the sill 124. Inserts 176 are retained in each of the rails 140, 144 to decrease air movement and heat transfer through hollows 178 (of the rails 140, 144) and 180 of the sill 124. The inserts 176 have a hollow "T" cross-sectional shape extending up from webs 177. The webs 177 may segregate the hollow 178 from hollow 180 in the sill 124. The roller assemblies 172 are accommodated between the webs 177 within the upright shaft 179 of the inserts 176 and are optionally mechanically supported by the inserts 176.

The sill 124 has subsections 124*a*-124*d*, some of which, e.g., 124*b* and 124*d* may be made of a material with a lower heat conductivity than that of other subsections, e.g., 124*a*, 124*e* to functional as thermal breaks. The tracks 174 may also be made at least partially from a material exhibiting low heat conductivity, e.g., a rigid polymer and have an upstanding portion 182 that interacts with the roller assemblies 172 and a web portion 184. Since the web portions 184 subdivide hollows 180, they can diminish heat transfer attributable to convection through the hollows 180.

It will be understood that the embodiments described herein are merely exemplary and that a person skilled in the art may make many variations and modifications without departing from the spirit and scope of the claimed subject matter. For example, while the present disclosure refers to inserts for the structural members of moveable windows and doors, the teachings of the present disclosure could be applied to other structures employed in establishing and maintaining a building envelope, such as skylights and fixed window systems. In addition, the teachings of the present disclosure could also be applied to any hollow structural members, such as columns or beams in a building to achieve a reduction of heat transfer through those structures. While most hollow structural members commonly encountered are at least partially filled with air, the present disclosure is also applicable to hollow members containing other substances supporting convection, such as inert gases, like Nitrogen or Argon, or liquids, such as water. The insert may be dimensioned to be retrofitted to be accommodated within the hollow of an existing structural member design. All such variations and modifications are intended to be included within the scope of the appended claims.

We claim:

1. A structure for a building envelope dividing an exterior environment from an interior environment, comprising:

a composite member having a pair of metal extrusions having a first thermal conductivity, the pair of extrusions connected by a thermal break formed from a material having a lower thermal conductivity than the metal extrusions, a first of the pair of extrusions being an exterior extrusion and a second of the pair being an interior extrusion, the composite member having a portion with an open, C-shaped cross-sectional shape, the hollow of the C-shaped cross-sectional shape communicating with a space exterior to the composite member, the hollow supporting heat transfer by convection between the pair of metal extrusions;

a monolithic insert formed independently of the composite member having stable free-standing dimensions, the insert inserting into the hollow and extending at least partially across the hollow, the insert being made from a material with a thermal conductivity less than the thermal conductivity of the metal extrusions and having a cross-sectional shape which at least partially subdivides the hollow into a plurality of sub-areas, the insert having an open U-shaped cross-sectional shape with a first wall extending at least partially across the open C-shape, the first wall defining the bottom of the U-shape and joining to a first side wall at one end and to a second side wall at another end, the first side wall and the second sidewall defining the side walls of the U-shape, the insert reducing the Nusselt number of the composite member relative to the Nusselt number of the composite member without the insert present in the hollow.

2. The structure of claim 1, wherein the insert has a pair of arms, a first arm extending from the first side wall distal to the first wall and extending toward the first of the pair of extrusions and a second arm extending from the second side wall distal to the first wall and extending toward the second of the pair of extrusions.

3. The structure of claim 1, further comprising at least one extension extending from the bottom of the U-shaped insert in a direction toward the thermal break.

4. The structure of claim 3, further comprising a ledge member extending from an end of at least one of the pair of arms distal to the first wall, at least one of the pair of metal extrusions having an edge disposed proximate the hollow, the ledge member engaging the at least one edge, retaining the insert in the hollow.

5. The structure of claim 4, wherein each of the pair of metal extrusions has an edge disposed proximate the hollow and further comprising a pair of extensions extending from the bottom of the U-shaped insert in a direction toward the thermal break and wherein the ledge member is a first ledge member and further comprising a second ledge member extending from another of the pair of arms, the insert being captured within the hollow with each of the first and second ledge members engaged with one of the edges and with each of the pair of extensions abutting against the bottom of the C-shape.

6. The structure of claim 5, wherein the each of the first ledge member and the second ledge member is oriented as a lead-in for slipping over one of the edges when the insert is pressed into the hollow.

7. The structure of claim 5, wherein each of the pair of arms has a first portion having a component of extension in a direction parallel to the first wall and a second portion extending at an angle relative to the first portion.

8. The structure of claim 1, wherein the first and second side walls are disposed perpendicular to the first wall.

9. The structure of claim 1, wherein the composite member receiving the insert is at least one of a head or a sill of a door.

10. The structure of claim 1, wherein the composite member receiving the insert is at least one of a head or a sill of a window.

11. The structure of claim 1, wherein the insert is composed of at least one of PVC and polyurethane.

12. The structure of claim 1, wherein the insert is composed of a deformable, low durometer material.

13. A structure, comprising a frame with a head having a first composite member with a first pair of metal extrusions having a thermal conductivity, the first pair of extrusions connected by a first thermal break formed from a material having a lower thermal conductivity than the first pair of metal extrusions, a first of the first pair of extrusions being an exterior extrusion and a second of the first pair being an interior extrusion, the first composite member having a portion with a first open, C-shaped cross-sectional shape defining a first hollow, the first hollow communicating with a space exterior to the first composite member, the first hollow supporting heat transfer by convection between the first pair of metal extrusions;

at least one first insert formed independently of the first composite member having stable free-standing dimensions, the at least one first insert inserting into the first hollow and extending at least partially across the first hollow, the at least one first insert being made from a material with a thermal conductivity less than the thermal conductivity of the first pair of metal extrusions and having a cross-sectional shape which at least partially subdivides the first hollow into a plurality of sub-areas, the at least one first insert having an open U-shaped cross-sectional shape with a first wall extending at least partially across the first open C-shape, the first wall defining the bottom of the U-shape and joining to a first side wall at one end and to a second side wall at another end, the first side wall and the second side wall defining the side walls of the U-shape, the at least one first insert reducing the Nusselt number of the first composite member relative to the Nusselt number of the first composite member without the at least one first insert present in the hollow;

a panel sliding relative to the frame and having a head with a second composite member with a second pair of metal extrusions having a thermal conductivity, the second pair of extrusions connected by a second thermal break formed from a material having a lower thermal conductivity than the second pair of metal extrusions, a first of the second pair of extrusions being an exterior extrusion and a second of the second pair being an interior extrusion, the second composite member having a portion with a second open, C-shaped cross-sectional shape defining a second hollow, the second hollow communicating with a space exterior to the second composite member, the second hollow supporting heat transfer by convection between the second pair of metal extrusions;

at least one second insert formed independently of the second composite member having stable free-standing dimensions, the at least one second insert inserting into the second hollow and extending at least partially across the second hollow, the at least one second insert being made from a material with a thermal conductivity less than the thermal conductivity of the second pair of metal extrusions and having a cross-sectional shape which at least partially subdivides the second hollow into a plurality of sub-areas, the at least one second insert having an open U-shaped cross-sectional shape with a first wall extending at least partially across the second open C-shape, the first wall defining the bottom of the U-shape and joining to a first side wall at one end and to a second side wall at another end, the first side wall and the second side wall defining the side walls of the U-shape, the at least one second insert reducing the Nusselt number of the second composite member relative to the Nusselt number of the second composite member without the at least one second insert present in the second hollow, the first hollow and the second hollow facing and communicating with each other.

14. The structure of claim 13, wherein the at least one first insert and the at least one second insert interdigitate, producing a tortured constricted path for air passing through the first and second hollows, such that the panel can be lifted in the frame and the at least one first insert and the at least one second insert reduce the heat transfer through the communicating first and second hollows.

15. The structure of claim 14, wherein the open hollow of the frame has a pair of retainer beads extending from the interior of the first C-shape, retaining opposing edges of the at least one first insert, and the second hollow has a pair of retainer ledges extending from the interior of the second C-shape, the at least one second insert having a pair of resilient arms with retainer tips that engage the retainer ledges when in a relaxed state.

16. The structure of claim 15, wherein the at least one first insert has a pair of arms extending from the U shape, such that the at least one first insert approximates a hollow T-shaped cross-sectional shape.

17. The structure of claim 15, wherein the thermal break of the first composite member has a divider member, the divider member extending into the first C-shaped hollow, dividing the first C-shaped hollow and defining two adjacent C-shaped hollows, each accommodating a panel member therein, and wherein the at least one first insert includes a second at least one first insert, a first of the adjacent C-shaped hollows having the first of the at least one first inserts and a second of the adjacent C-shaped hollows having the second of the at least one first inserts inserted therein, and wherein the at least one second inserts includes a second of the at least one second inserts, a first of the panel members having the first of the at least one second inserted therein and a second of the panels members having the second of the at least one second inserts inserted therein, the first of the at least one first inserts interdigitating with the first of the at least one second inserts and the second of the at least one first inserts interdigitating with the second of the at least one second inserts.

* * * * *